US009800965B2

(12) United States Patent
Miehl et al.

(10) Patent No.: US 9,800,965 B2
(45) Date of Patent: Oct. 24, 2017

(54) MULTI-MICROPHONE PORTING AND VENTING STRUCTURE FOR A COMMUNICATION DEVICE

(71) Applicant: MOTOROLA SOLUTIONS, INC., Schaumburg, IL (US)

(72) Inventors: Andrew P. Miehl, Boca Raton, FL (US); Patrick S. Claeys, Pembroke Pines, FL (US); Deborah A. Gruenhagen, Southwest Ranches, FL (US); Karl F. Mueller, Sunrise, FL (US); David M. Yeager, Delray Beach, FL (US); Jorge L. Garcia, Plantation, FL (US); Andrew A. Efanov, Crystal Lake, IL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 14/887,205

(22) Filed: Oct. 19, 2015

(65) Prior Publication Data

US 2017/0111720 A1 Apr. 20, 2017

(51) Int. Cl.
*H04R 1/08* (2006.01)
*H04R 1/28* (2006.01)
(Continued)

(52) U.S. Cl.
CPC ..... *H04R 1/086* (2013.01); *H04R 1/283* (2013.01); *H04R 1/2815* (2013.01);
(Continued)

(58) Field of Classification Search
CPC ..... H04R 1/02; H04R 1/025; H04R 1/086; H04R 1/2876; H04R 1/326; H04R 1/406; H04R 1/42; H04R 3/005; H04R 7/16; H04R 7/18; H04R 31/00; H04R 31/003; H04R 31/006; H04R 2201/003; H04R 2201/02; H04R 2201/107; H04R 2201/40;
(Continued)

(56) References Cited

U.S. PATENT DOCUMENTS 8,213,634 B1 * 7/2012 Daniel ..... H04R 3/005 381/122
8,284,966 B2 10/2012 Wilk et al.
2004/0165739 A1 * 8/2004 Akens ..... H04R 1/20 381/189
2007/0127759 A1 6/2007 Zhang et al.
(Continued)

FOREIGN PATENT DOCUMENTS

EP 2490411 A1 8/2012
JP 201001134 A 1/2010

OTHER PUBLICATIONS

The International Search Report and The Written Opinion, corresponding patent application No. PCT/US2016/057435, filed: Oct. 18, 2016, all pages.

*Primary Examiner* — Mark Fischer
(74) *Attorney, Agent, or Firm* — Barbara R. Doutre

(57) ABSTRACT

A microphone porting and venting assembly (100) is formed of a remote support substrate (118) providing a (130) acoustically resistive element with dedicated venting cavities (132) along with an external baffle (220) providing acoustic channels (212, 214, 216) which further provide water drainage and external sound sampling points (222, 224, 226). The microphone porting and venting assembly (100) is well suited waterproof, noise cancelling microphone systems.

23 Claims, 5 Drawing Sheets

(51) Int. Cl.

| | |
|---|---|
| ***H04R 1/40*** | (2006.01) |
| *H01Q 1/24* | (2006.01) |
| *H04R 1/34* | (2006.01) |

(52) U.S. Cl.
CPC ..... *H04R 1/2823* (2013.01); *H04R 1/2876* (2013.01); *H04R 1/406* (2013.01); *H01Q 1/243* (2013.01); *H04R 1/342* (2013.01); *H04R 2201/003* (2013.01); *H04R 2201/02* (2013.01); *H04R 2201/107* (2013.01)

(58) Field of Classification Search
CPC ..... H04R 2201/401; H04R 2201/403; H04R 2231/003; H04R 2307/204; H04R 2307/207; H04R 2400/07; H04R 2400/11; H04R 2499/11; H04R 1/44
See application file for complete search history.

(56) References Cited

U.S. PATENT DOCUMENTS

| | | | | |
|---|---|---|---|---|
| 2009/0174610 | A1* | 7/2009 | Korner | H04B 1/40 343/702 |
| 2010/0124957 | A1* | 5/2010 | Williams | A45F 5/02 455/575.6 |
| 2011/0188676 | A1* | 8/2011 | Momose | H04R 3/00 381/122 |
| 2014/0044297 | A1* | 2/2014 | Loeppert | H04R 1/04 381/355 |
| 2014/0294217 | A1 | 10/2014 | Yamaguchi et al. | |
| 2015/0163572 | A1 | 6/2015 | Weiss et al. | |
| 2015/0163588 | A1* | 6/2015 | Johansen | H04R 1/326 381/92 |
| 2015/0200462 | A1* | 7/2015 | Leppaluoto | H01Q 1/243 343/702 |

* cited by examiner

MULTI-MICROPHONE PORTING AND VENTING STRUCTURE FOR A COMMUNICATION DEVICE

FIELD OF THE INVENTION

The present invention relates generally to microphone porting and venting and more particularly to microphone porting and venting in a portable communication device. The ability to incorporate other communication components, such as an antenna, into the porting environment is also included.

BACKGROUND

Today's portable communication devices are challenged to incorporate an increased number of features into a small form factor. Portable radio products, such as those utilized in public safety, are further challenged by having to operate under severe environmental conditions, such as wet, dusty, and noisy conditions. A remote speaker microphone (RSM) is a portable accessory typically worn in a vertical position, at the shoulder operating in conjunction with another portable host radio worn about the wait. The RSM may utilize a plurality of microphones for noise cancellation of background noise. Noise canceling algorithms often demand that multiple microphones have a certain minimum spacing between them. This minimum spacing requirement is often in direct conflict with the overriding industry trend for communication devices to be made as small as possible. Additionally, providing drainage and venting paths for a microphone can be further complicated by the fact that there are multiple microphones that need to be spatially separated for noise canceling purposes.

In larger communication devices, the audio components and hardware can be spread out, and the microphone bodies can be mounted on the radio printed circuit board at a spacing that conforms to the requirements of the noise cancelling algorithm, whereas smaller portable communication devices are unable to mount the microphones on the radio pcb and still meet tight spacing limitations. The types of sealing membrane used also impact the overall design challenges associated with porting and venting a microphone.

Accordingly, it would be desirable to have a microphone assembly providing porting and venting for a portable communication device having a limited form factor. Incorporation of additional components within the limited form factor, such as an antenna, without taking up additional space, would be a further benefit.

BRIEF DESCRIPTION OF THE FIGURES

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
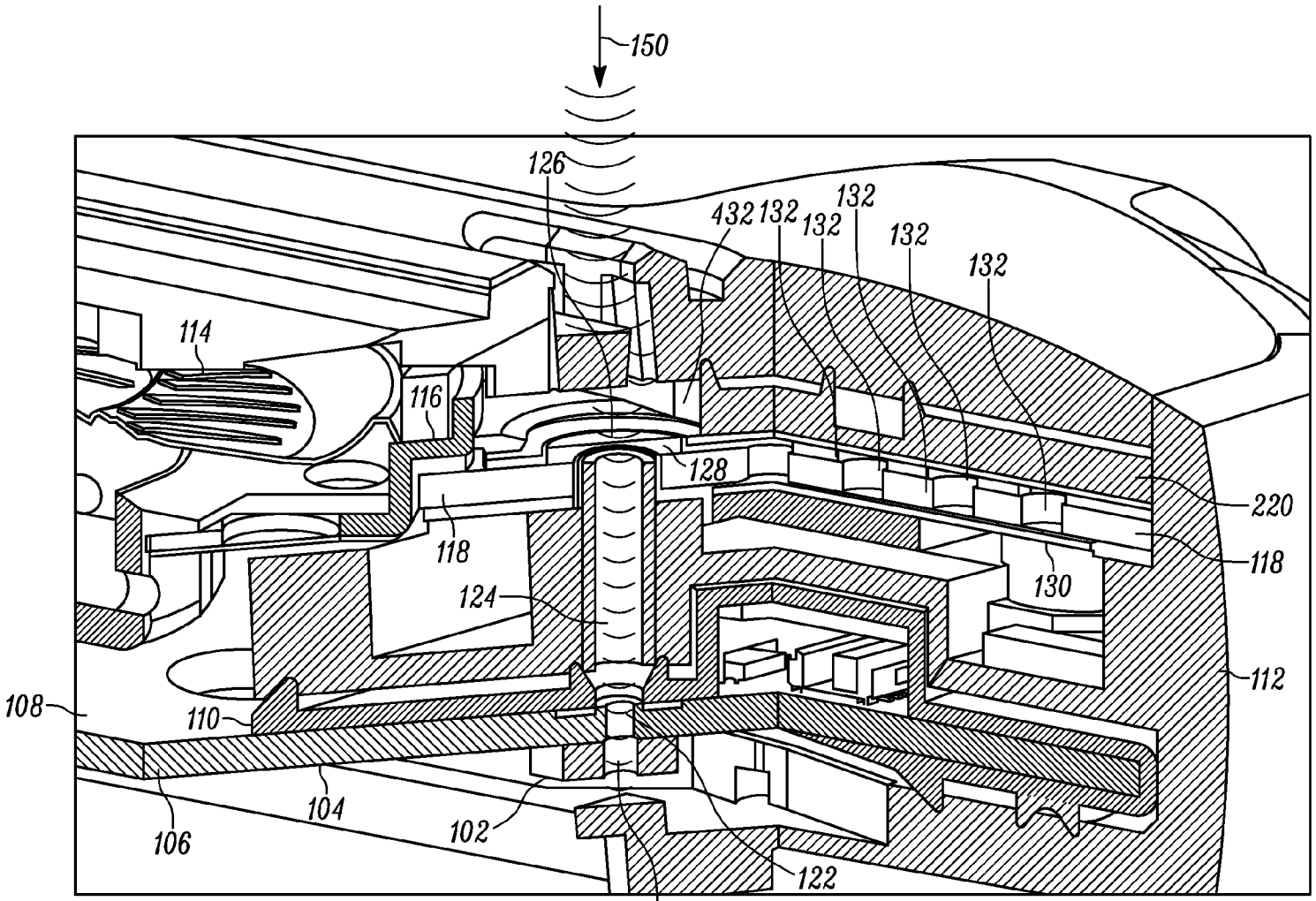
FIG. 1 is a partial cutaway view of a remote speaker microphone (RSM) having a porting and venting assembly in accordance with an embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in a microphone porting and venting assembly. The microphone porting and venting assembly is part of a microphone array implemented within a communication device, such as a remote speaker microphone requiring noise canceling algorithms which further require predetermined minimum spacing between the microphones. The improved porting and venting facilitates the ability to seal the microphones and provide drainage paths. The use of the remote support substrate having internal venting passages has been integrated into as part of a remote support substrate along with a baffle having separate acoustic vent cavities formed therein creates the acoustic equivalent of the missing real estate. The remote support substrate is further advantageously used as a carrier for antenna conductors providing sufficient antenna height above the printed circuit board (pcb) for frequency band operation.

Accordingly, the components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

FIG. 1 is a partial cutaway view of a portable communication device, such as a remote speaker microphone (RSM), having a microphone porting and venting assembly 100 formed in accordance with an embodiment. The RSM includes a plurality of microphones, one of which is shown as microphone 102 which is a bottom ported MEMs microphone, mounted to a printed circuit board 106 of housing 112. The RSM further comprise a speaker 114 mounted within a speaker basket 116 of housing 112. The RSM may provide, for example, two-way radio communication, such as half-duplex communication controlled via a push-to-talk switch in a public safety frequency range. Other communication devices may also take advantage of the microphone porting and venting assembly 100.

The pcb 106 has first and second surfaces 104, 108, and the microphone 102 is mounted upon first surface 104 such that a microphone port 120 of microphone 102 aligns with a pcb microphone port 122. A seal 110 having a hole seals around the pcb microphone port 122. The seal 110 further provides compartmentalized sealing for other components of the pcb 106 on both surfaces 104, 108. Housing 112 provides an internal elongated air passageway 124 formed therein providing a predetermined distance between the microphone 102 and a remote support substrate 118, formed in accordance with the embodiments. The internal elongated passage is for porting environmental acoustics, but the passage must also be internally air-pressure-vented (to prevent audio sensitivity swings).

Similarly, (although not shown) each microphone of the plurality of microphones has a similar internal elongated air passageway for porting and venting. The internal, elongated air passageway 124 (and those of the other microphones) provide part of the acoustic distance being sought to facilitate noise mitigation. A waterproof membrane 126 seals the housing's internal, elongated air passageway 124. Similar sealing is done to the other microphones. Waterproof membrane 126 will later be shown as part of an entire laminate which provides sealing for all the microphone ports, as part of a single laminate in conjunction with FIGS. 4 and 5. A baffle 220 with cut-outs, such as cut-out 432, will be further described in conjunction with FIGS. 2 and 4. Audio 150 is received through membrane 126 and ported through elongated air passageway 124 to microphone 102.

In accordance with the various embodiments, a vent path 128 is provided between the remote support substrate 118 and the elongated air passageway 124. In accordance with the embodiments, remote support substrate 118 provides an acoustic resistive element 130 and a plurality of vent cavities 132. Each microphone of the plurality of microphones has its own separate venting cavity 132 but all from the same remote support substrate 118 and all using the same resistive element 130. The singular resistive element 130 is partitioned into separate resistive sections 131, on the microphone side (dry side), which serve to vent each separate microphone acoustic cavity 132. FIG. 1 shows at least part of each separate vent cavity 132 for each of a plurality of microphones. In this embodiment, there are four vent cavities 132 each dedicated to a separate "front-firing" microphone—one of which is shown as microphone 102.

In accordance with the various embodiments, this "dry-side" venting is being done because of the challenge using a waterproof, non-permeable membrane, such as membrane 126. Unlike some waterproof membranes that are waterproof but still pass air, a waterproof, non-permeable membrane makes for a far more reliable, ruggedized device but also makes for a far more challenging device to vent to maintain acoustics. Appropriate venting and pressure equalization is important particularly for a communication device incorporating assembly 100 as it may be subjected to changes in environmental conditions. The assembly 100 having a waterproof, airtight membrane 126, vented in accordance with the various embodiments can advantageously maintain acoustic performance even under sudden temperature changes. Such temperature changes causing pressure changes would have severely degraded acoustic performance of other past assemblies.

Thus, the plurality of separate air passageways, such as air passageway 124, will converge only after each separate air passageway has passed through a single acoustic resistive venting element, such as resistive venting element 130 that has been divided into vent cavities 132. Depending on the design and size parameters of the device, the number of vent cavities 132 can be adjusted for the number of microphones being used. Discrete acoustic resistive element 130 creates at least a portion of each discrete physical vent for each microphone.

The remote support substrate 118 is non-conductive. The remote support substrate 118 may be made of such materials as printed circuit board substrate (FR4), plastic, or other suitable substrate. The resistive element 130 of remote support substrate 118 refers to an acoustically resistive element, not electrically resistive.

In accordance with the embodiments, providing remote porting, venting and acoustical resistivity for microphone 102, which has in some past products been handled by a discrete element on the pcb, is now being advantageously handled by a remote piece part—the remote support substrate 118 to create acoustical distance allowing a plurality of microphones to be implemented into smaller noise cancelling communication devices.

Placing the acoustically resistive element 130 along with connecting vent cavities 132 on the remote support substrate 118 away from the pcb 106 relinquishes a significant amount of board space that can then be advantageously used to carry other surface mount components. The microphone porting and venting assembly 100 also reduces piece parts and improving manufacturability. In accordance with the embodiments, each microphone is provided with a dedicated section 131 of the resistive element 130 per microphone and its own dedicated cavity of the plurality of cavities 132 and thus each microphone that utilizes the remote support substrate 118 to carry its venting sinus tracks (to be shown on FIG. 4) gains the space-savings benefit.

The remote support substrate 118 further serves as a support for the speaker basket 116, while providing remote porting, venting and resistivity for microphone 102. In accordance with a further embodiment, the remote support substrate 118 will also be shown to serve as a substrate upon which to deposit an antenna, in conjunction with FIG. 3.

Figure 2:
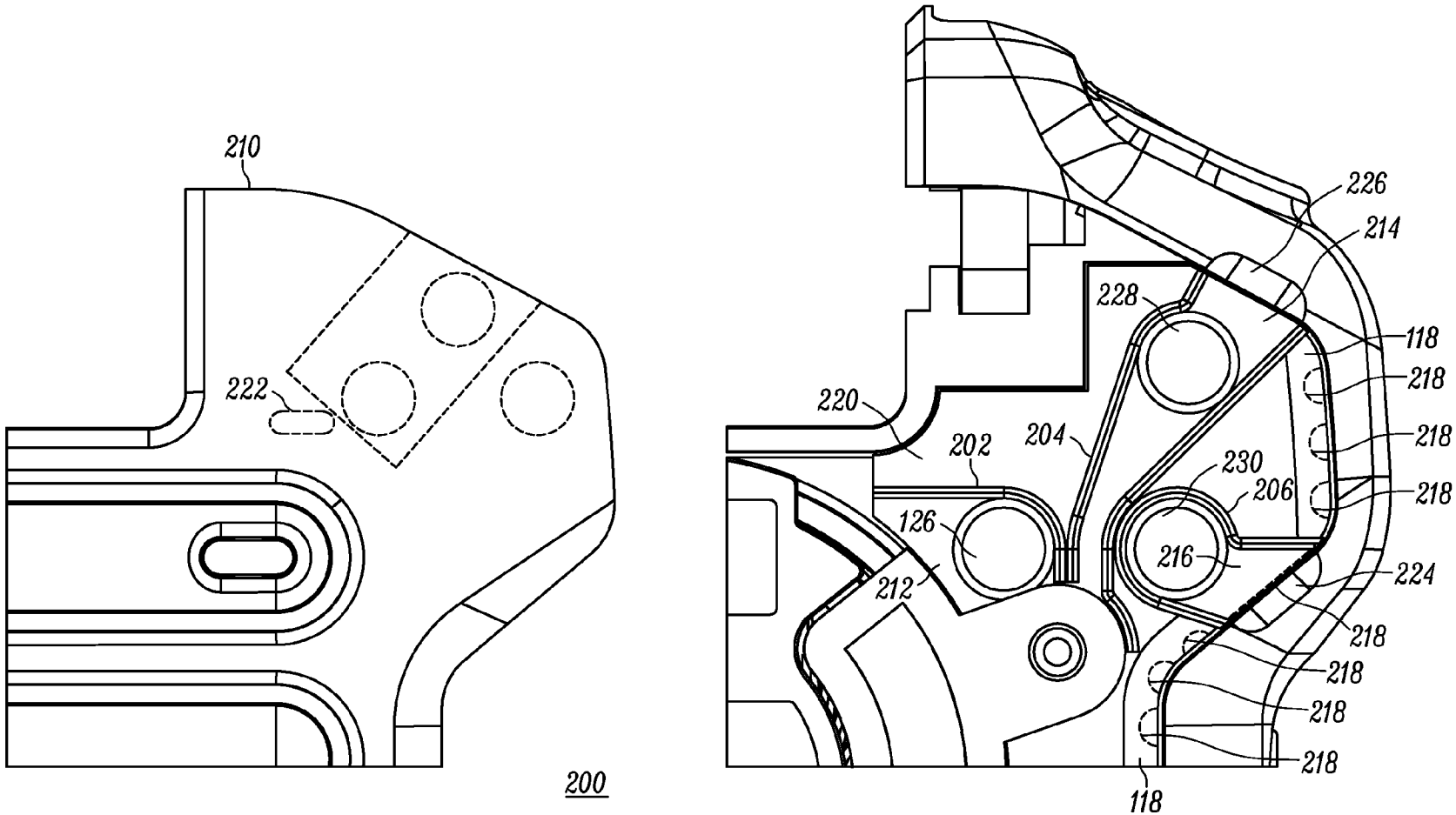
FIG. 2 is another partial view of the RSM showing a baffle for multi-microphone acoustic channels and drainage in accordance with an embodiment.

FIG. 2 shows cover 210 and partial cutaway view of the front of the RSM comprising a baffle for multi-microphone acoustic channels and drainage 200 in accordance with an embodiment. Another layer, which will be referred to as baffle 220 is coupled to the external side of remote support substrate 118. Baffle 220 comprises ribbed members 202, 204, 206 partitioning active acoustic channels 212, 214, 216 while allowing for drainage of water from the individual channel partitions. The baffle 220 is formed of ribbed members 202, 204, 206 which limit internal corrections to spacing limitations by adding extra lateral port length upstream from the acoustically active waterproof membranes 126, 228, 230. Waterproof membranes 228 and 230 align with elongated air passageways and microphones (not shown) but similar to elongated air passageway 124 and microphone 102 of FIG. 1. Waterproof membranes 126, 228, 230 are actually part of a single waterproof membrane sheet which will be shown in conjunction with FIG. 4.

The baffle 220 is configured to acoustically separate each microphone in any particular use case vector pair from each other, but can allow "crosstalk" to other microphones that are not a part of the orthogonal use case vector pair. The baffle's active acoustic channels 212, 214, 216 are also configured to allow water to easily drain from them. This structure can be used to address predetermined spacing requirements. The structure can be adjusted for other spacing requirements by adjusting the internal housing ports and the resistivity provided by each cavity of the remote support substrate 118.

In accordance with a further embodiment, the remote support substrate 118 further comprises an antenna 218 deposited thereon. The antenna 218 may be deposited, by known means such as by laser deposition. For example, an LDS process uses a thermoplastic material, doped with a metal-plastic additive activated by means of laser. Thus, remote support substrate 118 will have conductive antenna traces 218 when further used as an antenna. In this embodiment, the antenna 218 provides LTE frequency band operation (4G wireless broadband). However, other bands of operation may be feasible depending on device requirements and space limitations. The remote support substrate 118 is shown as having two sections, and the antenna preferably is deposited on both of these sections. The internal antenna conductor structure 218 is deposited on the non-conductive, remote support substrate 118 with protrusions which are conformal to the acoustic vent cavities 132 and the external baffle 220. This allows utilization of the physical volume allocated for the plurality of active acoustic vent cavities 132 to be re-used for antenna operation. The antenna is only deposited on the substrate 118. The protrusions allow bringing the antenna 218 closer to the outer surface of the product for better antenna performance.

Accordingly, the embodiments of FIGS. 1 and 2 have provided for external sampling points 222, 224, 226 used for testing audio. While the cancelling algorithms demand that the external sound sampling point of each microphone have a certain minimum spacing between them, the baffle 220 formed of ribs 202, 204, 206 further creates the acoustic equivalent of spatial real estate. The remote support substrate 118 resistive element 130 and internal venting cavities 132 has been integrated into the remote support substrate 118, as opposed to the pcb 106. The internal venting cavities 132 of the acoustically resistive remote support substrate 118 have been integrated into the design while the active acoustic channel 212 and microphone 102 are protected from water ingress by the external non breathable, waterproof membrane 126. Waterproof membrane 126 protects the acoustic side of the microphone component 102, while seal 110 can be considered to protect the electrical side of the microphone component.

Figure 3:
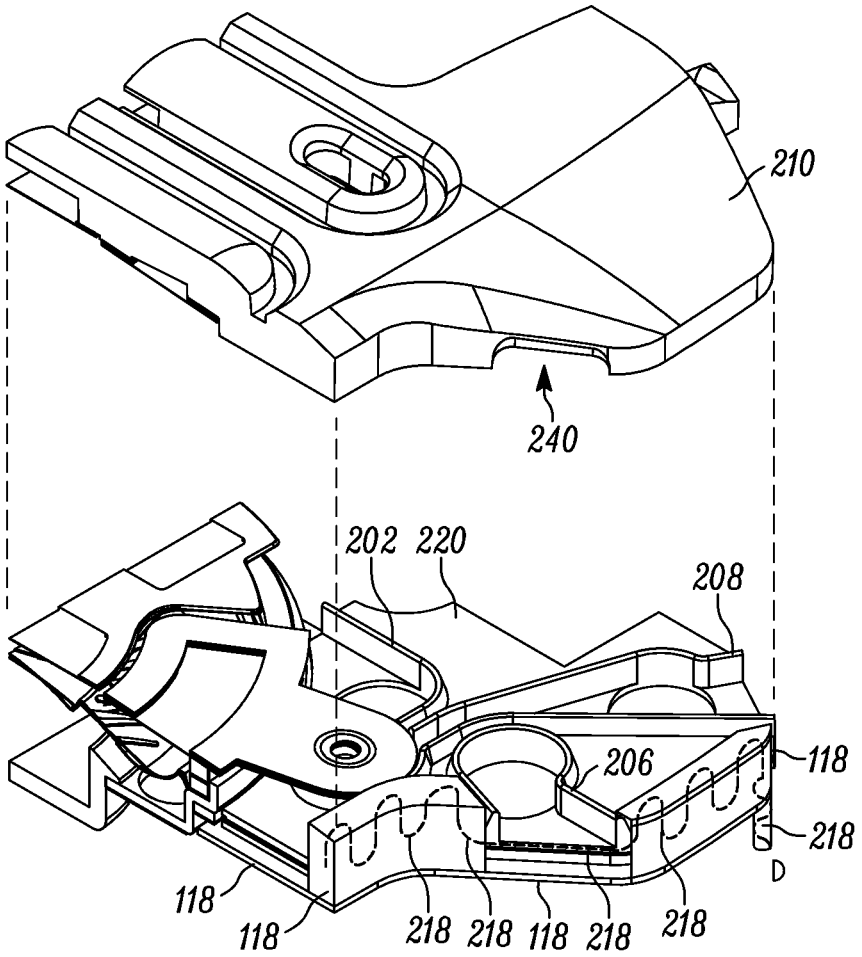
FIG. 3 is another partial view of the RSM showing a remote support substrate having antenna integrated thereon in accordance with an embodiment.

FIG. 3 shows cover 210, baffle 220 and remote support substrate 118 in accordance with another embodiment. In this embodiment, the remote support substrate 118 is formed with an extended carrier for receiving an antenna conductor 218. In accordance with a further embodiment, the remote support substrate 118 further comprises an antenna 218 deposited thereon. The antenna 218 may be deposited, by known means such as by laser deposition. In this embodiment, the antenna 218 provides LTE frequency band operation (4G wireless broadband). However, other bands of operation may be feasible depending on device and space limitations. The internal antenna conductor structure 218 is deposited on the non-conductive, remote support substrate 118 which acts as a carrier providing wall protrusions along the remote support substrate. This allows utilization of the physical volume allocated for the multiple active acoustic vent cavities 132 to be re-used for antenna operation.

FIG. 3 also shows baffle 220 with ribs 202, 206, 206 dividing up the acoustic channels. Cover 210 is shown with drainage port 240 for aligning with acoustic channel 216. Cover 210 includes other similar drainage ports (not shown) for the other acoustic channels.

Figure 4:
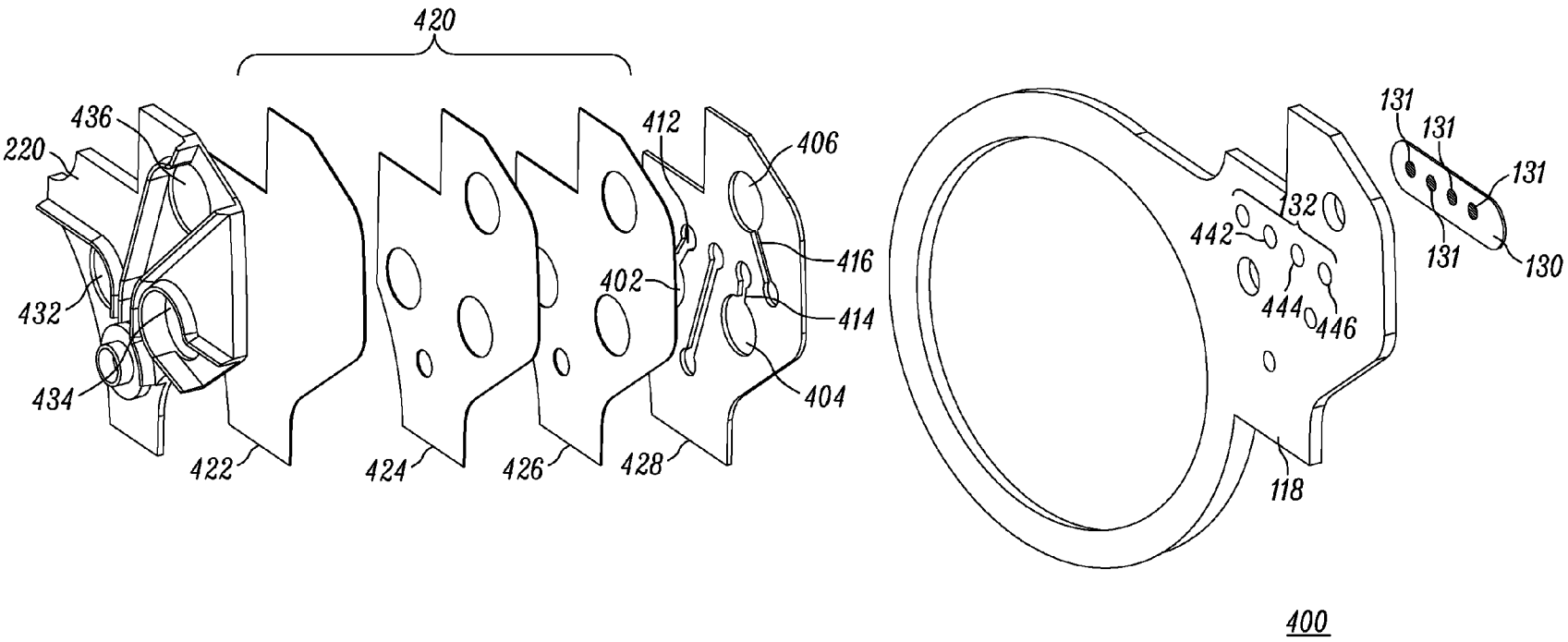
FIG. 4 is an exploded view of the baffle, waterproof membrane laminate, and resistive support substrate in accordance with an embodiment.
Figure 5:
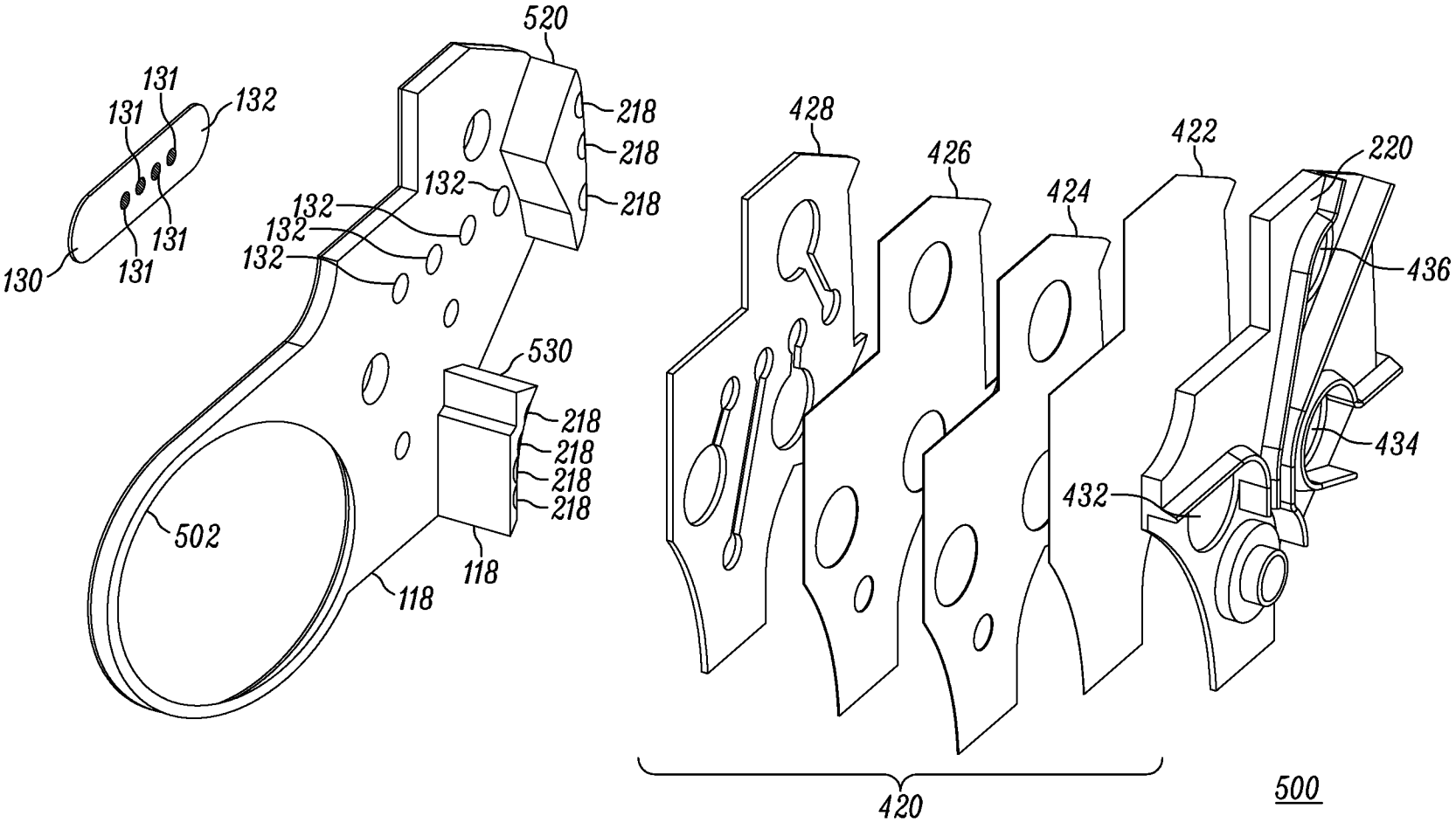
FIG. 5 is another exploded view of the baffle, waterproof membrane laminate, and resistive support substrate wherein the resistive support substrate further acts as a carrier for an antenna conductor in accordance with an embodiment.

FIG. 4 is an exploded view 400 of the baffle 220, a waterproof membrane laminate 420, and the resistive support substrate 118 in accordance with an embodiment. The individual elongated air passageways 124 are not shown in this view as these are integrated within the housing 112, and shown in FIG. 1. The waterproof membrane laminate 420 is a laminate that provides the waterproof, airtight membranes 126, 228, 230 which are all part of a single laminate. Waterproof membrane laminate 420 is formed of a waterproof, airtight seal 422, such as a polyether ether ketone (PEEK) layer, a pressure sensitive adhesive layer 424, a tension layer 426, such as polyethylene terephthalate (PET) tension layer, and a pressure sensitive adhesive layer 426. Different material combinations can be used to make up the laminate 420 but the overall membrane should provide for a waterproof, airtight membrane to fit to the baffle 220 with interior mic cut-outs 402, 404, 406 for aligning with corresponding baffle cut-outs 432, 434, 436. Sinus tracks 412, 414, 416 in layer 428 lead each microphone into one dedicated vent cavity of the plurality of vent cavities 132. In FIG. 4, three of the plurality of vent cavities are labeled as 442, 444, and 446. Microphone 102 of FIG. 1 would vent through sinus track 412 into dedicated vent cavity 442 having resistive element 130. Again, resistive element 130 is an acoustic resistive element comment to all FIG. 5 is another exploded view 500 of the baffle, waterproof membrane laminate, and resistive support substrate wherein the resistive support substrate 118 further acts as a carrier 520, 530 for an antenna conductor 218 in accordance with an embodiment. The antenna 218 may be deposited, by known means such as by laser deposition. The remote support substrate 118 is shown as having two sections, 520, 530 (protruded walls) and the antenna 218 preferably is deposited on both of these sections and connected in between. The internal antenna conductor structure 218 is deposited on the backwall protrusions 520, 530 conforming to the substrate 118. This allows utilization of the physical spaces that was allocated to the remote support substrate to be re-used for antenna operation. Thus, the remote support substrate 118 supports the speaker basket at 502, the antenna 218 and provides vent cavities 132 for the microphones.

Accordingly, there has been provided a waterproof, noise cancelling microphone system for bottom ported microphones. The microphone porting and venting structure 100 of the embodiments provides the remote support substrate 118 formed of the resistive element 130 with dedicated venting cavities 132, along with the baffle 220 providing active acoustic channels 212, 214, 216 with external sound sampling points 222, 224, 226, all of which have been incorporated into a single portable communication device having a limited form factor.

The microphone porting and venting assembly 100 facilitates sealing for ruggedized environmental conditions including drainage while providing noise cancellation mitigation. While public safety communication devices, such as remote speaker microphones (RSM) worn in a vertical position, at the shoulder, would greatly benefit from the sealing, drainage, and noise cancellation provided by the various embodiments, any communication device where ruggedness and good sealing in a small form factor are desired can benefit from the porting and assembly apparatus of the various embodiments.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A microphone porting and venting assembly, comprising:

a housing comprising a plurality of separated elongated air passageways formed therein for each of a plurality of microphones, the plurality of microphones being mounted to a printed circuit board;

a waterproof and non-permeable membrane coupled over the plurality of separated elongated air passageways;

a remote support substrate coupled to the plurality of separated elongated air passageways the remote support substrate providing a single acoustic resistive venting element and separate venting cavities for each of the plurality of microphones; and a baffle comprising ribbed members partitioning active acoustic channels while allowing for drainage of water from individual channel partitions.

2. The microphone porting and venting assembly of claim 1, wherein each individual acoustic channel for each of the plurality of microphones converges only after each microphone's separated elongated air passageway has channeled through the single acoustic resistive venting element and the respective separate venting cavity of the remote support substrate.

3. The microphone porting and venting assembly of claim 1, wherein the remote support substrate providing separate venting cavities further comprises protrusions between the separate venting cavities.

4. The microphone porting and venting assembly of claim 3, further comprising:

an internal antenna conductor being deposited on the remote support substrate aligned with the protrusions, the remote support substrate being a non-conductive, remote support substrate.

5. The microphone porting and venting assembly of claim 4, wherein the internal antenna conductor is configured for long term evolution (LTE) frequency operation.

6. The microphone porting and venting assembly of claim 1, wherein the remote support substrate provides a converged microphone vent path with a passage to a main internal air volume of a portable communication device.

7. The microphone porting and venting assembly of claim 1, wherein the plurality of microphones provides noise-cancelling mitigation.

8. The microphone porting and venting assembly of claim 1, wherein predetermined spacing between microphones is required for a predetermined noise cancellation threshold.

9. The microphone porting and venting assembly of claim 1 wherein the microphone porting and venting assembly is incorporated into a remote speaker microphone (RSM).

10. The microphone porting and venting assembly of claim 1, wherein the microphone porting and venting assembly is a microphone porting and venting assembly for a plurality of microphones.

11. A portable communication device, comprising:

a housing;

a printed circuit board (pcb) having a microphone port coupled within the housing;

a bottom ported microphone mounted to the pcb and ported through the pcb microphone port;

an internal elongated air passageway formed within the housing and aligned with the pcb microphone port;

a waterproof, non-permeable membrane coupled over the internal elongated air passageway;

a remote support substrate, the remote support substrate having a plurality of vent cavities for venting into the portable communication device;

an acoustic resistive element coupled to the plurality of vent cavities;

a vent path coupled from the internal elongated air passageway to the remote support substrate beneath the waterproof, non-permeable membrane; and a baffle comprising ribbed members partitioning active acoustic channels while allowing for drainage of water.

12. The portable communication device of claim 11, wherein the communication device comprises a plurality of microphones, and the remote support substrate provides separate venting cavities for each microphone.

13. The portable communication device of claim of claim 11, wherein the remote support substrate provides a converged microphone vent path with a passage to a main internal air volume of the portable communication device.

14. The portable communication device of claim of claim 11, wherein the portable communication device is a vertically worn shoulder mounted remote speaker microphone.

15. The portable communication device of claim of claim 11, wherein the remote support substrate is a non-conductive, remote support substrate used as a carrier for an antenna conductor providing sufficient antenna height above the printed circuit board (pcb) for frequency operation.

16. The portable communication device of claim of claim 11, wherein the remote support substrate further comprises first and second protrusions extending therefrom and upon which an antenna conductor is laser deposited.

17. The portable communication device of claim of claim 11, wherein the remote support substrate further comprises a long term evolution (LTE) antenna.

18. A portable communication device, a housing;

a printed circuit board (pcb) having a microphone port coupled within the housing;

a bottom ported microphone mounted to the pcb and ported through the pcb microphone port;

an internal elongated air passageway formed within the housing and aligned with the pcb microphone port;

a waterproof, non-permeable membrane coupled over the internal elongated air passageway;

a remote support substrate, the remote support substrate having a plurality of vent cavities for venting into the portable communication device;

an acoustic resistive element coupled to the plurality of vent cavities;

a vent path coupled from the internal elongated air passageway to the remote support substrate beneath the waterproof, non-permeable membrane; and wherein the remote support substrate further supports a speaker basket of the portable communication device.

19. A portable communication device, comprising:

a housing;

a printed circuit board (pcb) having a microphone port coupled within the housing;

a bottom ported microphone mounted to the pcb and ported through the pcb microphone port;

an internal elongated air passageway formed within the housing and aligned with the pcb microphone port;

a waterproof, non-permeable membrane coupled over the internal elongated air passageway;

a remote support substrate, the remote support substrate having a plurality of vent cavities for venting into the portable communication device;

an acoustic resistive element coupled to the plurality of vent cavities;

a vent path coupled from the internal elongated air passageway to the remote support substrate beneath the waterproof, non-permeable membrane; and wherein a multi-layer laminate provides sinus tracks for venting each of a plurality of microphones to the acoustic resistive element and a separate dedicated vent cavity of the plurality of vent cavities of the remote support substrate.

20. A substrate, comprising:

a plurality of microphone vent cavities;

a support for a speaker basket; and wherein the substrate provides pressure equalization and venting between a waterproof, non-permeable membrane and a plurality of ported microphones.

21. The substrate of claim 20, further comprising:

an acoustic resistive element coupled to the substrate, the acoustic resistive element providing venting sections for each of the plurality of microphone vent cavities.

22. The substrate of claim 20, further comprising:

a carrier formed as part of the substrate, the carrier having an antenna conductor deposited thereon.

23. A substrate, comprising:

a plurality of microphone vent cavities;

a support for a speaker basket; and a laminate coupled thereto providing an outer, waterproof, non-permeable membrane and an inner layer of sinus tracks for venting each of a plurality of microphones into each of the plurality of microphone vent cavities.

* * * * *